United States Patent [19]

Jakobs

[11] Patent Number: 4,913,431

[45] Date of Patent: Apr. 3, 1990

[54] BASKETBALL RETRIEVAL AND RETURN DEVICE

[76] Inventor: Benedikt Jakobs, Hassberg 1, D-8960 Kempten, Fed. Rep. of Germany

[21] Appl. No.: 247,902

[22] Filed: Sep. 22, 1988

[51] Int. Cl.[4] ..... A63B 69/00

[52] U.S. Cl. ..... 273/1.5 A

[58] Field of Search ..... 273/1.5 A, 396, 397

[56] References Cited

U.S. PATENT DOCUMENTS

| | | | |
|---|---|---|---|
| 1,924,757 | 8/1933 | Shisoff | 273/103 |
| 3,085,800 | 4/1963 | Holstad | 273/1.5 A |
| 3,776,550 | 12/1973 | McNabb | 273/1.5 A |
| 3,814,421 | 6/1974 | Spier, Jr. | 273/1.5 A |
| 3,917,263 | 11/1975 | Wiley | 273/1.5 A |
| 4,291,885 | 9/1981 | Cohen | 273/347 |
| 4,667,957 | 5/1987 | Joseph | 273/1.5 A |
| 4,697,810 | 10/1987 | Mathison | 273/1.5 A |

*Primary Examiner*—Paul E. Shapiro

*Attorney, Agent, or Firm*—Notaro & Michalos

[57] ABSTRACT

A basketball retrieval and return device comprises a retrieval net in the form of a funnel having a large upward opening with inclined rear, front and side walls that extend downwardly and inwardly toward a downward opening. The downward opening is somewhat larger in diameter than a basketball. An arcuate tube is pivotally connected to the downward opening of the net and can be freely pivoted about a vertical axis. A running duct is connected to the bottom of the tube for guiding the basketball to a remote location which is preferably a shooting position for a player. A stop at the end of the running duct stops and holds the basketball for use by the player. A counterweight connected to an opposite end of the running duct counter balances the running duct at the location of the discharge end so that the running duct is held a slight distance away from the playing court.

12 Claims, 3 Drawing Sheets

BASKETBALL RETRIEVAL AND RETURN DEVICE

BACKGROUND OF THE INVENTION

This invention relates to a device for use in practicing basketball shots, so as to relieve a player or players of the task of manually retrieving balls from under or around a basketball basket and returning same to the player or players on a court, thereby making more efficient use of available practice time. Accordingly, the invention provides a device for collecting balls which are shot toward a basketball net, and for mechanically returning the balls to a selected on-court location.

STATEMENT OF PRIOR ART

U.S. Pat. No. 4,579,340 shows a basketball retrieval and return device comprising a retriever in the shape of a funnel having an enlarged upward opening extending substantial distances sideward and outward from a point beneath a basket assembly, the retriever having a downward opening of a diameter somewhat greater than that of a basketball, elongated guiding means arranged beneath the downward opening and pivotably supported on a frame about a vertical axis of the downward opening, the elongated guiding means having a front portion extending forward from said vertical axis to a discharge end above the floor and having a rearward portion extending from the vertical axis in an opposite direction.

The retriever extends downwards and rearwards from beneath the basket assembly and in the lower part thereof is curved forwardly. The guiding means consist of a short cylindrical tube which is mounted for rotation on a vertical driving shaft of an electric motor. In the rearward portion of the tube a solenoid-actuated axial plunger is provided for expelling a basketball through the forward end of the tube. The discharge end of the tube is arranged substantially normal to the basketball assembly. Therefore, and because the horizontal tube lies at a low level above the floor, the expelled basketball will contact the floor at a short distance from the discharge end of the tube and then will roll over the floor from which it must be picked up.

U.S. Pat. No. 3,776,550 shows a similar device in which a curved running duct is associated with the retrieval funnel. The discharge end of the running duct is at floor level and comprises a motor-driven projecting mechanism to throw the basketball to the player. The position of the running duct cannot be changed.

U.S. Pat. No. 3,814,421 shows a short arcuate tube removably fastened below the basket hoop. The discharge opening is at a height substantially above the floor, so that the basketball can drop out of the tube in a predetermined direction which can be changed by lifting the tube and re-installing it in a different angular position. A basketball is returned through the tube only if the player has made a basket.

U.S. Pat. No. 3,233,896 shows a very simple basketball return device, in which a long tube in the form of netting is fastened at its upper end to the basket assembly and the discharge end of the tube is affixed to a stand whose position can be changed.

SUMMARY OF THE INVENTION

One object of the invention is to provide a basketball retrieval and return device which is simple and can be manufactured at low cost but yet enables the player to pick up the returned basketballs at different positions far away from the basket assembly.

It is one further object of the invention to provide such a device which can return nearly every ball which has been shot into the area of the basket assembly to a predetermined position independently of having made a basket or of having hit the backboard.

One further object of the invention is to provide a device of this kind which can be handled by the player during his normal practice to rapidly change the discharge position without using motor-driven mechanisms.

Another object of the invention is to provide a retrieval and return device which is able to store a plurality of basketballs at the discharge end of the returning device far away from the basket assembly and on an elevated level above the floor so that the player need not bend or stoop.

The basketball retrieval and return device of the invention therefore comprises a retriever in the shape of a funnel having an enlarged upward opening extending substantial distances sideward and outward from a point beneath a basket assembly, the retriever having a downward opening of a diameter somewhat greater than that of a basketball, elongated guiding means arranged beneath the downward opening and pivotably supported on a frame about a vertical axis of the downward opening, the elongated guiding means having a front portion extending forward from said vertical axis to a discharge end above the floor and having a rearward portion extending from said vertical axis in an opposite direction, said guiding means comprising a straight projecting, downwardly inclined running duct, the running duct having a longitudinal extension at least twice as great as the height of the upward opening of the retriever above the bottom and extending on-court to a location in the region of the penalty throw border, the vertical axis positioned with a spacing ahead of a vertical plane intersecting the basket assembly, the rearward portion of the guiding means carrying a balance weight so dimensioned that the running duct together wth any components connected therewith for pivoting about the vertical axis is at least substantially counterbalanced in said vertical axis so that a small push given by hand of the player against the discharge end of the running duct will be sufficient to let the running duct swing about the vertical axis into another angular position.

Thanks to this invention a simple device is achieved which returns nearly each ball thrown in the direction of the basket assembly. The returned ball is stored at a discharge position above the floor so that the player can pick up and shoot one ball after another without the need to wait and to concentrate on picking up the balls. In contrast the player can pick up the balls blindfolded. Thanks to the easy-running slewability of the extremely long but balanced running duct, the player needs only slightly push against the discharge end of the duct to pivot the duct and change the angular discharge position with respect to the swinging axis.

These together with other objects, features and advantages of the invention will become subsequently apparent from the details of construction and operation of the invention as more fully hereinafter described and claimed, reference being had to the accompanying drawings forming a part hereof, wherein like numerals refer to like parts throughout.

DESCRIPTION OF PREFERRED EMBODIMENT

Figure 1:
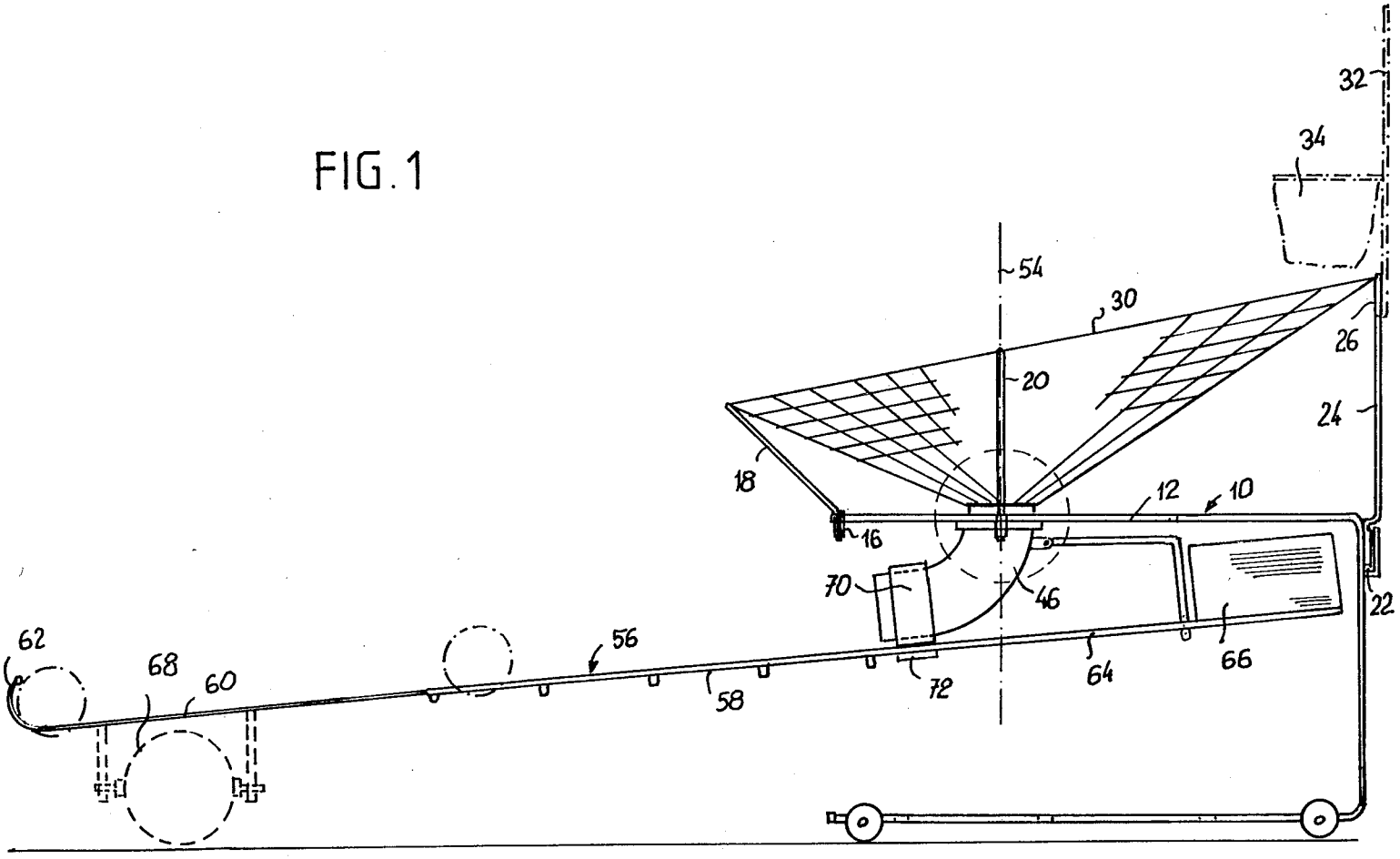
FIG. 1 is a schematic side view of a basketball return device.
Figure 2:
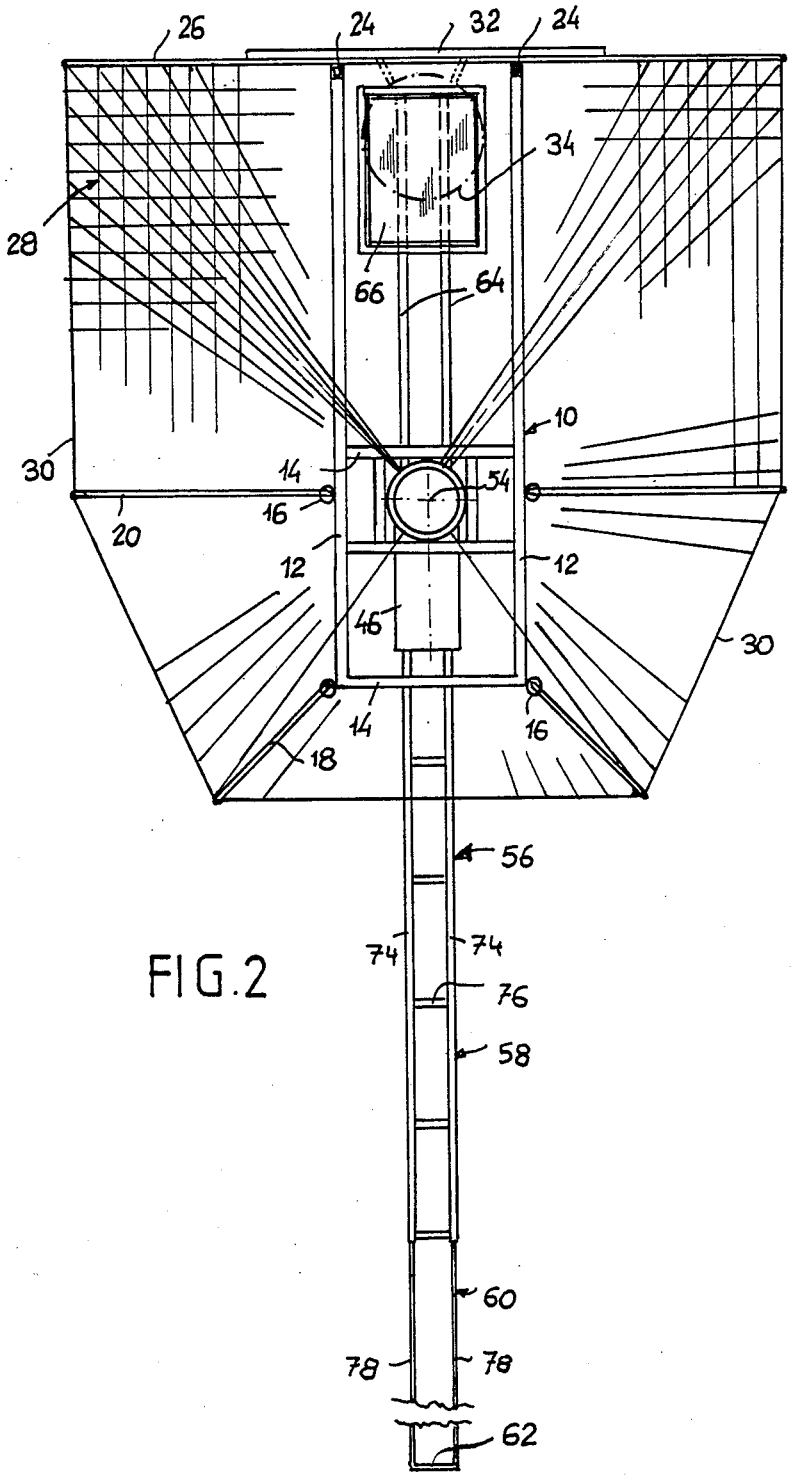
FIG. 2 is a plan view of the device according to FIG. 1.
Figure 3:
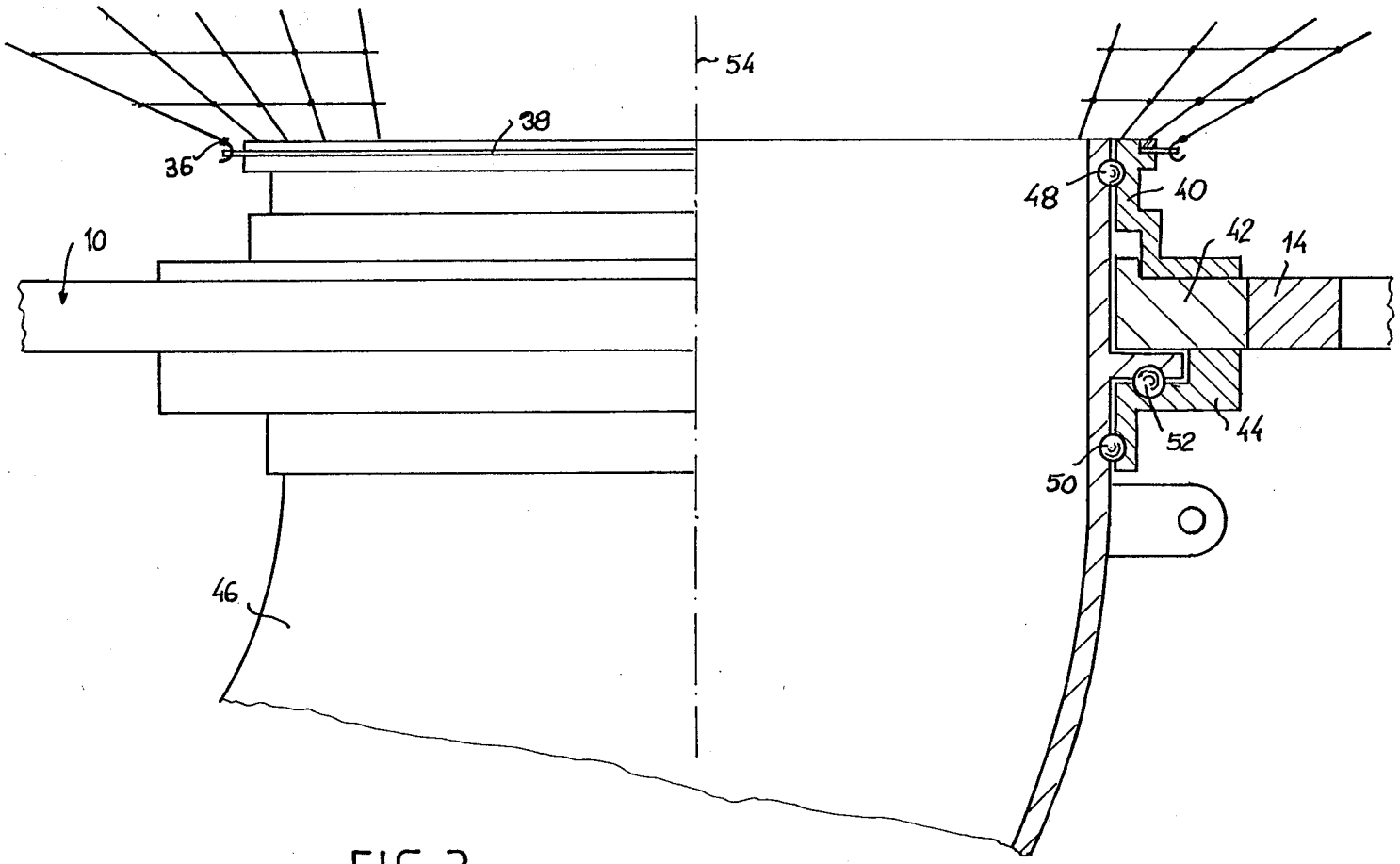
FIG. 3 is an enlarged partially sectional view of a bearing arrangement of a running duct of the invention.

A frame 10 is generally C-shaped as seen from the side. The frame 10 is composed of a pair of identical side frames 12 connected by cross-bars 14. Each side frame 12 has an upper horizontal leg, an upright rearward leg and a lower horizontal leg. The frame 10 is open at its front side. At the upper legs of the side frames 12 bushings 16 are fastened by welding into which inclined struts 18, 20 are removably inserted. A pocket 22 is provided at the rearward leg of each side frame 12. The pockets 22 each have upper inserting openings. An upright bar 24 is inserted into each one of the pockets 22. A cross bar 26 connects both upright bars 24 above frame 10. The cross bar 26 projects beyond the upright bars 24 at both sides. A rearward upper edge of a funnel-shaped net 28 is fastened at the cross bar 26. The upper edge 30 of the net 28 is further hung in hooks provided at the upper ends of the four struts 18, 20. The upper edge 30 of the net 28 defines an upward opening. A basket assembly 32, 34 is removably fastened at the cross bar 26 as shown in dot dash line because the basket assembly can alternatively be arranged on a separate stand.

The upper edge 30 of the net 28 is arranged in a forwardly sloping inclined plane extending immediately beneath the basket 34. Therefore, the basket 34 is not out-of-sight for the player.

The funnel-shaped net 28 has a circular lower edge 36 defining a downward opening of the net. The net 28 forms a retriever in which the upward opening is at least ten times greater than the downward opening and the smaller one of the length and the width of the upward opening is at least twice as great as the height of the retriever. Further it can be seen, that the downward opening is arranged a remarkable distance ahead of the rearward edge of the net 28. The lower edge 36 of the net 28 is removably fastened at a circular ring 38 which is fastened at a bearing housing 40 which itself is fastened on an annular flange 42 welded on a pair of cross bars 14 of the frame 10. A further bearing housing 44 is fastened from below at the annular flange 42.

An upper vertical end of an arcuate cylindrical tube 46 is mounted for free rotation about a vertical axis 54 of the circular ring 38 in both bearing housings 40, 44 by means of two radial ball bearings 48, 50 and an additional axial ball bearing 52. The arcuate tube 46 extends about a peripheral angle of substantially 80° and has an inner diameter corresponding to the basketball diameter. A straight guiding duct 56 having a great length of approximately 8 meters is fastened to the arcuate tube 46 and is connected therewith so that a basketball leaving a discharge end of the arcuate tube will enter the guiding duct which is slightly inclined and consists of two sections 58, 60. The lower end section 60 is telescopically extensible in the longitudinal direction and is provided with an elevated basketball stop 62 at the discharge end thereof which is positionable near a shot position of the playing court, spaced from the basketball basket.

The guiding duct 56 extends beyond the vertical axis 54 by means of an arm 64 in the rearward direction and a balance or counter weight 66 is mounted on the rearward end of arm 64. The balance weight 66 is so dimensioned that the whole swinging structure comprising the completely extended guiding duct 56 projecting approximately 8 meters from the vertical axis and carrying two basketballs at the discharge end thereof and the arcuate tube 46 is counterbalanced at the vertical axis 54. Therefore, in spite of the very long projecting guiding duct the whole swinging structure can easily be swung by somewhat more than 180° about the vertical axis 54 without having any floor contact. A small push by hand of the player against the discharge end of the guiding duct 56 will be sufficient to course the guiding duct 56 to swing about an angle of for example 90° into a new position. Therefore two or more players can train simultaneously, because one of them after having picked up a basketball from the guiding duct pushes the guiding duct in the direction of the other player and then makes his shot, while the other player takes another ball from the duct and pushes the duct in the opposite direction again.

If the frame and the bearing arrangement for the swinging structure substantially consisting of tube 46 and guiding duct 56 is a light-weight construction, the weight of the balance weight 66 can be reduced by providing a light-weight hollow thin-walled rotational solid 68 having a large diameter beneath the discharge end of the guiding duct 56. The rotational solid 68 in the form of a disc-shaped body or a ball or wheel is mounted for free rotation about a horizontal axis positioned in a central vertical plane of the guiding duct 56. This horizontal axis for rotation is arranged substantially at half the height of the guiding duct at the discharge end thereof. By this additional rotational body 68 the very long projecting guiding duct 56 is supported so that the duct 56 is prevented from seesawing. Furthermore, the rotational body 68 is hermetically closed and filled with a gaseous medium which is lighter than air, for example helium. Therefore, the rotational body 68 additionally provides a lifting force on to the discharge end of the guiding duct 56 whereby the mass of the counterweight 66 can be reduced.

The section 58 of the guiding duct 56 consists of two parallel straight long tubes 74 spaced from one another by a distance smaller than the basketball diameter. The distance is in the range of 50% to 80% of said diameter. The two parallel tubes are connected with one another by downwardly bent cross-struts 76. The extensible section 60 of the guiding duct 56 consists also of two straight tubes 78 which are longitudinally displaceable in the tubes 74 respectively and can be clamped by screws (not shown). The tubes 78 are connected with one another only by one end cross-strut, which is elevated and lies in the moving path of a bsketball and forms the stop member 62 therefore.

On the discharge end of the arcuate tube 46 a fastening ring 70 is provided at the bottom side of which the guiding duct 56 is pivoted by means of a bracket 72. The arm 64 is additionally strutted by an angled strut which is fastened at a rearwardly extending bracket at the upper end of the arcuate tube 46. The angled strut has a downwardly extending leg provided with a plurality of holes one above another and the arm 64 is fastened at that leg by a screw bolt going through one of the plurality of holes. By choosing another hole the inclination of the guiding duct 56 and therefore the discharge height of the discharge end thereof can be adjusted.

I claim:

1. A basketball retrieval and return device for use with a basketball having a basketball diameter, on a playing court with a basket and a shot position spaced from the basket, the device comprising:

a retriever in the shape of a funnel having front, rear and side walls defining an enlarged upward opening, the front, rear and side walls being inclined downwardly and inwardly to a downward opening having a vertical axis and a diameter which is greater than the basketball diameter;

a frame connected to the retriever for supporting the retriever around the vertical axis;

elongated guiding means arranged beneath the downward opening and pivotally supported on the frame for swinging movement about the vertical axis, the elongated guiding means having a front portion extending forwardly from the vertical axis to a discharge end which is adapted to be spaced above the playing court, the elongated guided means having a rear portion extending from the vertical axis in an opposite direction from the front portion, the guiding means comprising a straight, projecting running duct inclined downwardly from the downward opening of the retriever to the discharge end, the running duct having a longitudinal length which is at least twice as great as a vertical height of the retriever from the downward opening to the upward opening thereof, the running duct being adapted for extending to the shot position of the playing court when the vertical axis of the downward opening is positioned in front of the basket of the playing court; and a counterweight connected to the rear portion of the guiding means, the counterweight having a weight selected for substantially counter balancing the elongated guiding means about the vertical axis whereby the running duct can be swung around the vertical axis by the application of a small pushing force against the discharge end of the guiding means.

2. A basketball retrieval and return device as claimed in claim 1, wherein the upward opening of the retriever is at least ten times greater than the downward opening and the smaller one of the length and the width of the upward opening is at least twice as great as the height of the retriever.

3. A basketball retrieval and return device as claimed in claim 1, wherein the upward opening of the retriever has a rearward edge, and the downward opening of the retriever is spaced forwardly of the rearward edge.

4. A basketball retrieval and return device as claimed in claim 1, including a cylindrical arcuate tube arranged beneath the downward opening of the retriever, the tube having an upper opening arranged beneath and adjacent to the downward opening of the retriever, the upper opening of the tube defining a vertical inlet portion for receiving a basketball, the tube having a lower opening with a diameter which is substantially the same as a diameter of the upper opening, the running duct being rigidly connected to the tube at a location for receiving a basketball on the running duct from the lower opening of the tube, and a bearing housing including a ball bearing ring connected between the tube and the frame for pivotally mounting the tube and the running duct with respect to the retriever.

5. A basketball retrieval and return device as claimed in claim 4, wherein the running duct is composed of at least two telescopically extensible sections.

6. A basketball retrieval and return device as claimed in claim 4, wherein the upward opening of the retriever is arranged in a geometrical plane which in a forward direction is downwardly inclined.

7. A basketball retrieval and return device as claimed in claim 4, including a strut connected to the tube and connected at an adjustable position to the running duct for adjusting the inclination of the running duct.

8. A basketball retrieval and return device as claimed in claim 1, wherein the running duct comprises a pair of parallel tubes arranged with an interspace therebetween smaller than the basketball diameter, the pair of tubes connected to one another by a plurality of downwardly bent cross struts which are spaced from one another in the longitudinal direction of the pair of tubes.

9. A basketball retrieval and return device as claimed in claim 1, wherein adjacent the discharge end of the running duct a hollow lightweight rotatory supporting body is mounted for rotation about a horizontal axis which is parallel with a vertical central plane of the running duct, said horizontal axis being adapted to be arranged at a level above the court substantially half as great as the level of the discharge end of the running duct.

10. A basketball retrieval and return device as claimed in claim 9, wherein the supporting body is hermetically closed and filled with a gaseous medium having a specific gravity smaller than air.

11. A basketball retrieval and return device as claimed in claim 1, wherein stop means for a basketball are arranged at the discharge end of the running duct in a moving path of the basketballs on the running duct.

12. A basketball retrieval and return device as claimed in claim 1, wherein the frame, in side view, is C-shaped, the frame comprising a horizontal upper leg, a bottom leg parallel to the upper leg, and a rearward upright leg connected between the upper and bottom legs, said guiding means being pivotally mounted to the horizontal upper leg and extending beneath the upper leg, the frame including a plurality of upright struts, removably connected to the upper leg and extending upwardly and outwardly from the upper leg, the retriever comprising a funnel shaped net connected taughtly between the struts.

* * * * *